US007250584B2

(12) United States Patent
Asmus et al.

(10) Patent No.: US 7,250,584 B2
(45) Date of Patent: Jul. 31, 2007

(54) CONTACT ELEMENT COMPRISING ROUNDED SLOT EDGES

(75) Inventors: Caspar Asmus, Berlin (DE); Klaus Oberndörfer, Berlin (DE); Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/534,704

(22) PCT Filed: Oct. 13, 2003

(86) PCT No.: PCT/DE03/03461

§ 371 (c)(1),
(2), (4) Date: Dec. 6, 2005

(87) PCT Pub. No.: WO2004/047135

PCT Pub. Date: Jun. 3, 2004

(65) Prior Publication Data

US 2006/0124601 A1 Jun. 15, 2006

(30) Foreign Application Priority Data

Nov. 15, 2002 (DE) ..... 102 53 866

(51) Int. Cl.
*H01H 33/66* (2006.01)

(52) U.S. Cl. ..... 218/128; 218/123

(58) Field of Classification Search ..... 218/118, 218/120, 123–129, 10, 16, 17, 146
See application file for complete search history.

(56) References Cited

U.S. PATENT DOCUMENTS

| | | | | |
|---|---|---|---|---|
| 4,210,790 | A * | 7/1980 | Kurosawa et al. | 218/127 |
| 4,324,960 | A * | 4/1982 | Aoki et al. | 218/128 |
| 4,453,054 | A * | 6/1984 | Peche et al. | 218/128 |
| 4,667,070 | A * | 5/1987 | Zuckler | 218/129 |
| 4,806,714 | A * | 2/1989 | Aoki | 218/129 |
| 5,387,771 | A | 2/1995 | Luehring | |
| 6,140,599 | A * | 10/2000 | Haas | 218/123 |
| 6,479,778 | B1 * | 11/2002 | Kimura et al. | 218/118 |
| 6,870,118 | B2 * | 3/2005 | Nishijima et al. | 218/128 |

FOREIGN PATENT DOCUMENTS

| | | |
|---|---|---|
| DE | 31 33 799 A1 | 3/1983 |
| DE | 34 15 743 A1 | 10/1985 |
| DE | 196 24 920 A1 | 1/1998 |
| DE | 197 17 024 A1 | 10/1998 |

* cited by examiner

*Primary Examiner*—Elvin Enad
*Assistant Examiner*—M. Fishman
(74) *Attorney, Agent, or Firm*—Morrison & Foerster LLP

(57) ABSTRACT

The aim of the invention is to prevent local spikes from being created in a contact element of a contact arrangement used for interrupting a current in a distribution network, said contact element comprising a contact support (8) that encompasses a hollow cylindrical wall section (9) and a bottom wall (10), and a contact disk (11) which is located opposite the bottom wall (10) in a longitudinal direction while slots (2) are provided for generating a magnetic field. Said aim is achieved by providing the slots (2) with rounded edges (3) having a defined radius.

7 Claims, 2 Drawing Sheets

CONTACT ELEMENT COMPRISING ROUNDED SLOT EDGES

CLAIM FOR PRIORITY

This application is a national stage of PCT/DE2003/003461, published in the German language on Oct. 13, 2003, which was filed in the english language on Nov. 15, 2002.

TECHNICAL FIELD OF THE INVENTION

The invention relates to a contact piece of a contact arrangement, and in particular, for interrupting a current in a distribution system, slots being provided for producing a magnetic field.

BACKGROUND OF THE INVENTION

In the conventional art, such a contact piece is known, for example, from DE 34 15 743 A1. Therein, a contact arrangement is shown for a vacuum interrupter. The contact arrangement has a stationary contact piece and a movable contact piece which is guided such that it can move in relation to the stationary contact piece, the contact pieces lying with their end faces opposite one another in the axial direction. The contact pieces each comprise a pot-shaped contact carrier, which has a hollow-cylindrical wall section and a base wall, and a contact disk which lies axially opposite the base wall. In order to produce an axial magnetic field, slots are provided in the base wall, the wall section and in the contact disk, and these slots delimit conductor tracks which extend helically, with the result that an azimuthal component is impressed on a current flowing via the contact piece and an axial magnetic field is produced. The contact piece designed in this way is envisaged for installation in a vacuum-operated power breaker which is provided for the purpose of interrupting the current flow in an energy distribution system, for example in the event of a short circuit.

By separating the contact pieces of the contact arrangement of the vacuum-operated power breaker, an arc is drawn between the contacts. The magnetic field produced by the slots counteracts a self-contraction of the arc and contributes to quenching of the arc. Owing to the slots provided in the contact disk, the occurrence of eddy currents in the contact disk is also suppressed. The slots are generally produced by metal-cutting manufacturing techniques such as milling, lathe work, drilling and are mechanically and/or electrochemically burred.

The previously known contact piece has the disadvantage that sharp edges are formed at the rims of the slots when said slots are introduced, and these sharp edges increase the electric field strengths, which are in any case very high in the contact region, by a factor β which may be between 3 and even over 10, depending on the radius of curvature of the edges and the contact spacing. However, high electric field strengths in the contact region have a disadvantageous effect on the dielectric strength of contact arrangements which are fitted with such contact pieces.

SUMMARY OF THE INVENTION

The invention provides a contact piece of the type mentioned initially which prevents high electric field strengths in the contact region of contact arrangements.

The invention achieves this object by the rims of the slots having rounded-off edges having a defined radius.

In accordance with one embodiment of the invention, the dielectric strength of a contact piece can firstly be influenced in a targeted manner. While the mechanical or electrochemical burring of previously known contact pieces leads to slot rims having edges whose curvature is more or less arbitrary, the rims of slots according to the invention have edges having a defined radius. In the process, the radius remains constant according to the invention over the entire extent of the slots so as to prevent local fluctuations in the dielectric strength in the case of contact arrangements having contact pieces according to the invention. The defined radii may be produced, for example, with the aid of a radius milling cutter which has been developed for this purpose, and thus mechanically. For this purpose, the radius milling cutter is passed through the entire slot. In addition, it is possible for the defined curvatures of the edges to be designed by means of numerically controlled machine tools and appropriately shaped milling heads. In the case of composite materials, for example comprising copper and chromium, it is also possible for the defined curvatures to be produced by means of powder metallurgy using the shaped part technique or by means of cold reforming, i.e. by means of embossing.

The radius R is advantageously set as a function of the voltage of the distribution system U in accordance with the rule on dimensions:

$$R \geqq 2\cdot 10^{-4}\cdot U^2 + 8.5\cdot 10^{-3}\cdot U + 0.34,$$

where U has the unit kilovolts and R has the unit millimeters. If these minimum values which are dependent on the voltage are adhered to, the contact piece has a particularly high dielectric strength.

The slots advantageously have slot ends in the form of a rounded hole. In this advantageous development of the invention, the production of the rounded-off edges having a defined radius is simplified further since the curvatures required in the end region of the slots which is difficult for machine tools to gain access to can be formed by simply drilling or circular milling.

In accordance with one development in this regard, the diameter of the rounded hole is in the region of a slot width of the slots. This setting of the dimensions further simplifies production of the edges with their defined curvatures in the end region of the slots.

As an alternative to this, the slots have rectangular slot ends. The production of this embodiment of the invention is made more difficult owing to the rectangular slot end formation. However, as little material as possible is removed from the contact piece by rounding off the edges of the rims, as a result of which the conductivity, the heat exchange and the robustness of the contact piece are improved.

The slots are advantageously provided in the wall section and are inclined with respect to the longitudinal direction. In this way, a coil former is produced which favors quenching of the arc.

In accordance with one advantageous development, the slots are formed in the contact disk. The provision of the slots in the contact disk prevents, for example, disadvantageous eddy currents in the contact disk. According to the invention, the slots may be provided exclusively in the contact disk or else both in the wall section and in the contact disk.

The slots in the contact disk are advantageously curved, in which case they follow the profile of the slots in the coil former. This increases the size of the azimuthal component of the current flowing via the contact piece and intensifies the magnetic field produced.

In addition, it may be advantageous if the slots are provided in the base wall. The slots in the base wall are advantageously curved such that an azimuthal component is impressed on the current as early as its flow via the base wall of the contact carrier. In this case, the slots in the coil former continue on from the slots in the base wall. In the context of the invention it is naturally also possible for the base plate, the coil former and also the contact disk to have slots.

BRIEF DESCRIPTION OF THE DRAWINGS

The invention is described in more detail below using exemplary embodiments of the invention with reference to the figures in the drawings, in which corresponding components are provided with the same reference numerals and in which.

DETAILED DESCRIPTION OF THE INVENTION

Figure 1:
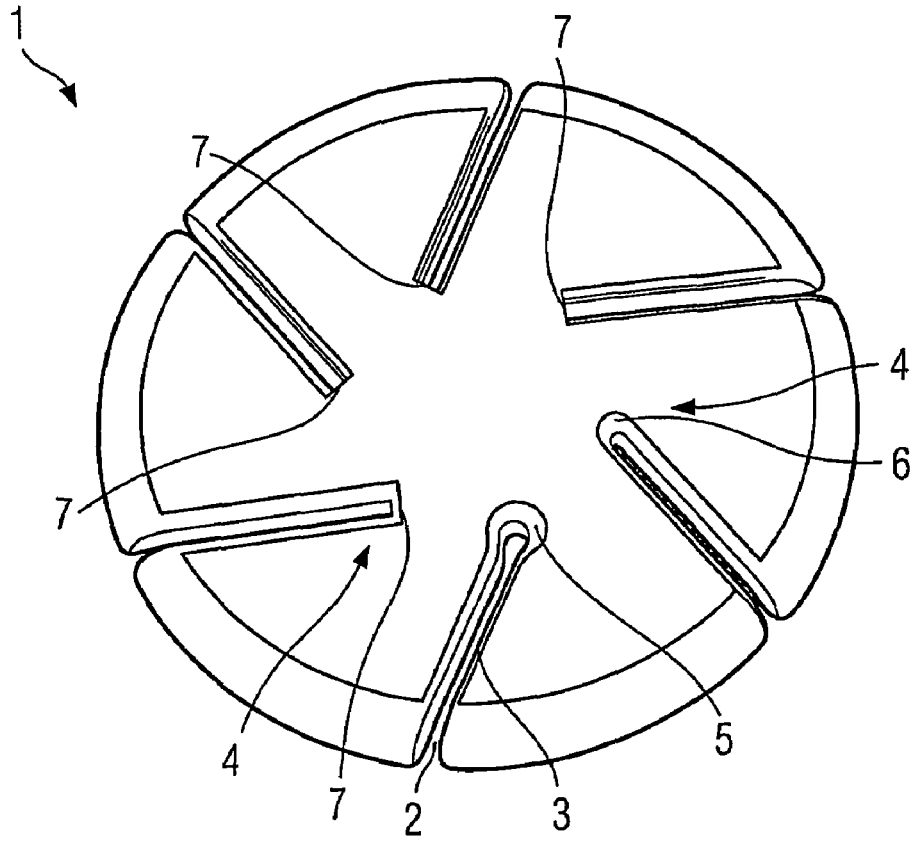
FIG. 1 shows an exemplary embodiment of a contact disk of the contact piece according to the invention.

FIG. 1 shows an exemplary embodiment of a contact disk 1 of the contact piece according to the invention. The contact disk 1 shown has a circular outer contour. Slots 2 are introduced into the contact disk 1 from the outside. The slots do not extend in the form of a star from the outside towards the center of the circular contact disk 1 but are formed such that they are at a slight angle with respect to the star-shaped profile, as a result of which an azimuthal component is impressed on a current flowing via the contact disk towards the center. In addition, the slots 2 serve the purpose of suppressing eddy currents.

The slots 2 are delimited by rims which have rounded-off edges 3. The radius of the edge curvature in the exemplary embodiment shown is 0.5 mm. Such a contact disk is therefore preferably suitable for use in distribution systems having an operating voltage of up to 27 kV, as results from the abovementioned rule on dimensions.

The edges 3 of the rims of the slots 2 are themselves rounded-off in the end regions of the slots 2, or in other words at the slot end 4, and have a constant radius of curvature over the entire slot profile. In the exemplary embodiment shown, however, different slot ends 4 are illustrated. The slot end which is given the reference numeral 5 is shaped in the form of a hole, whose radius essentially corresponds to the diameter of the slot 2. The slot end having the reference numeral 6 is likewise in the form of a hole, but the diameter of the hole essentially corresponds to the diameter of the slot 2.

The reference numeral 7 denotes rectangular slot ends, whose rims or limits have, however, rounded-off edges having a constant radius, as do the holes.

Figure 2:
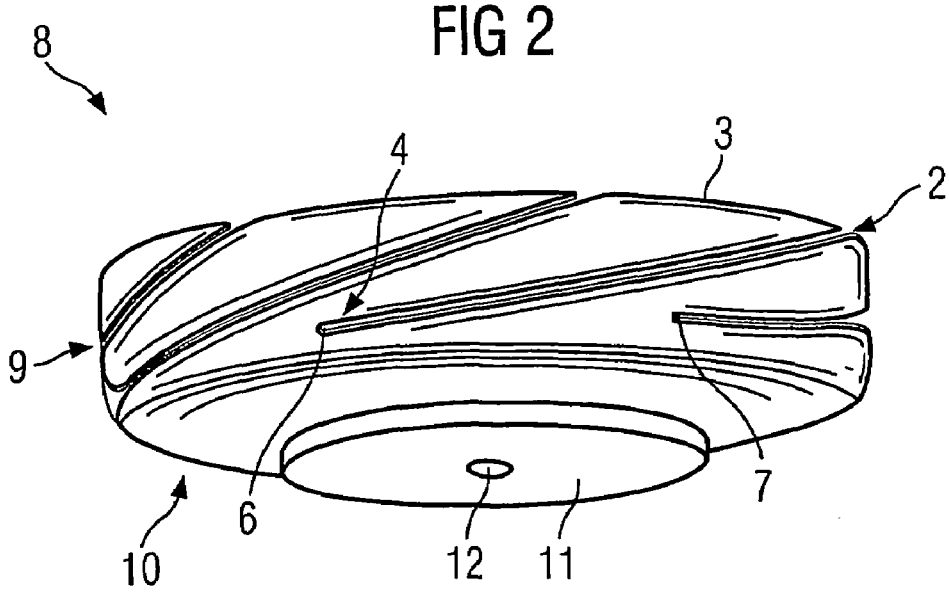
FIG. 2 shows an exemplary embodiment of a contact carrier of the contact piece according to the invention.
Figure 3:
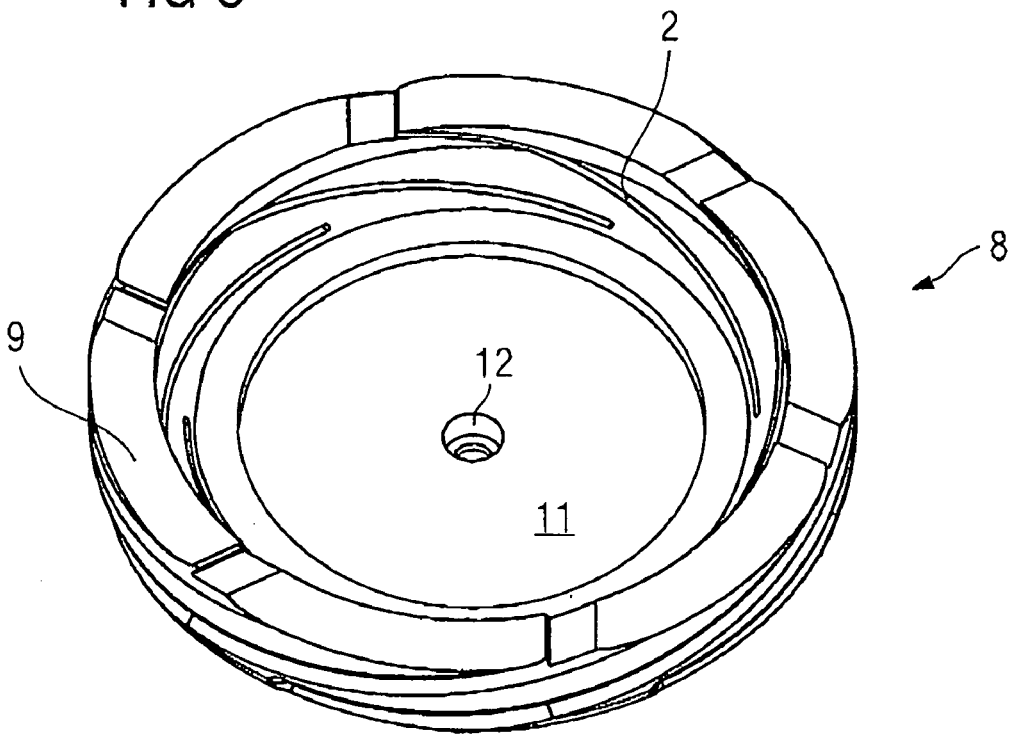
FIG. 3 shows an exemplary embodiment of a contact carrier having a hollow cylindrical wall section according to the present invention.

FIG. 2 shows an exemplary embodiment of a contact carrier 8 of a contact piece according to the invention which has a wall section 9 and a base wall 10. A fixing section 11 can also be seen in the base wall 10, and this fixing section 11 can be connected to a current-carrying contact bolt (not shown) at a fixing recess 12. As is the case with the contact disk 2, slots 2 are provided in the wall section 9 which have rims having edges 3. The rims of the slots 2 are rounded-off in their end regions or in other words at the slot ends 4, the slot ends 6 having the shape of a hole, whose diameter essentially corresponds to the diameter of the slot 2. As a deviation from this, the rim of a slot end 7 is rectangular.

The base wall 10 does not have any slots 2 in the exemplary embodiment illustrated.

The contact carrier is generally produced from a highly conductive material, such as copper. The contact disk 1 is advantageously made of a composite material and in particular of a copper/chromium alloy.

What is claimed is:

1. A contact piece of a contact arrangement for interrupting a current in a distribution system, comprising:

a contact carrier which has a hollow-cylindrical wall section and a base wall; and a contact disk which lies opposite the base wall in a longitudinal direction, slots being provided in said contact disc for producing a magnetic field, wherein rims of the slots have rounded-off edges having a defined radius R that is set as a function of a voltage of the distribution system U in accordance with a rule on dimensions:

$$R \geqq 2 \cdot 10^{-4} \cdot U^2 + 8.5 \cdot 10^{-3} \cdot U + 0.34,$$

where U has a unit kilovolts and R has a unit millimeters.

2. The contact piece as claimed in claim 1, wherein the slots have slot ends in a form of a rounded hole.

3. The contact piece as claimed in claim 2, wherein the diameter of the rounded hole is in a region of a slot width of the slots.

4. The contact piece as claimed in claim 1, wherein the slots have rectangular slot ends.

5. The contact piece as claimed in claim 1, wherein the slots are provided in the wall section and are inclined with respect to a longitudinal direction.

6. The contact piece as claimed in claim 1, wherein the slots are formed in the contact disk.

7. The contact piece as claimed in claim 1, wherein the slots are provided in the base wall.

* * * * *